US007360325B2

(12) United States Patent
Chen

(10) Patent No.: US 7,360,325 B2
(45) Date of Patent: Apr. 22, 2008

(54) MULTIPLY INSOLE

(76) Inventor: Yi-Hsi Chen, No. 112, Min Tsu Road, Miao Li City, Miao Li Hsien (TW)

( * ) Notice: Subject to any disclaimer, the term of this patent is extended or adjusted under 35 U.S.C. 154(b) by 133 days.

(21) Appl. No.: 11/099,449

(22) Filed: Apr. 6, 2005

(65) Prior Publication Data

US 2006/0156582 A1 Jul. 20, 2006

(30) Foreign Application Priority Data

Jan. 19, 2005 (TW) ..... 94201036 U

(51) Int. Cl.
*A43B 13/38* (2006.01)

(52) U.S. Cl. ..... 36/44

(58) Field of Classification Search ..... 36/43, 36/44

See application file for complete search history.

(56) References Cited

U.S. PATENT DOCUMENTS 3,616,029 A * 10/1971 Lerman ..... 156/276
4,054,706 A * 10/1977 Shapiro ..... 428/213
4,642,912 A 2/1987 Wildman et al.
4,658,515 A * 4/1987 Oatman ..... 36/44
5,762,735 A * 6/1998 Collins et al. ..... 156/78
6,481,120 B1 * 11/2002 Xia et al. ..... 36/44

* cited by examiner

*Primary Examiner*—Ted Kavanaugh
(74) *Attorney, Agent, or Firm*—Bacon & Thomas PLLC

(57) ABSTRACT

An insole includes a first layer made of a first slice foam material formed by a foamable polyurethane resin composition. A second layer is made of a second slice foam material formed by bonding together particles of comminuted previously formed foam material with a foamable polyurethane resin composition. The second layer is adhered to an upper surface of the first layer. The second layer has a thickness being greater than that of the first layer.

15 Claims, 1 Drawing Sheet

MULTIPLY INSOLE

BACKGROUND OF THE INVENTION

1. Field of the Invention

The present invention relates to an insole, and more particularly to a multiply insole having a better resilience and air permeability than that of the prior art insole.

2. Description of the Background

The conventional insole is defective in that the resilience thereof would die out after wear. An improved insole intended to provide a solution to the problem described above was disclosed in a U.S. patent bearing U.S. Pat. No. 4,642,912. The insole is characterized in that it has three layers being made of the same flexible foam material but different in compressive strength thereof. As a result, the insole has good retention of its cushioning properties after wear. But according the fact, the three-layer insole of the invention only provided 15 percent better cushioning than the prior art insole. In other words, the drawback of the prior art can not resolve effectively. In addition, the air permeability of the three-layer insole reduced due to the fact that it is laminated by so many layers made of same foam material.

SUMMARY OF THE INVENTION

The present invention has arisen to mitigate and/or obviate the disadvantage of the conventional insole.

In accordance with one aspect of the present invention, there is provided an improved multiply insole having a heel area, an arch area, and a forefoot, each defined on the top surface and corresponding to the respective areas of the foot and comprising a first layer made of a first slice foam material formed by a foamable polyurethane resin composition, a second layer made of a second slice foam material formed by bonding together particles of comminuted previously formed foam material with a foamable polyurethane resin composition, the second layer being adhered to an upper surface of said first layer; and the second layer having a thickness being greater than that of the first layer.

Further characteristics and advantages of the insole according to the present invention will become more apparent hereinafter from the following detailed disclosure of a preferred, though not exclusive, embodiment of the invention, which is illustrated, by way of an indicative, but not limitative, example, in the accompanying drawings, where:

DETAILED DESCRIPTION OF THE INVENTION

Figure 1:
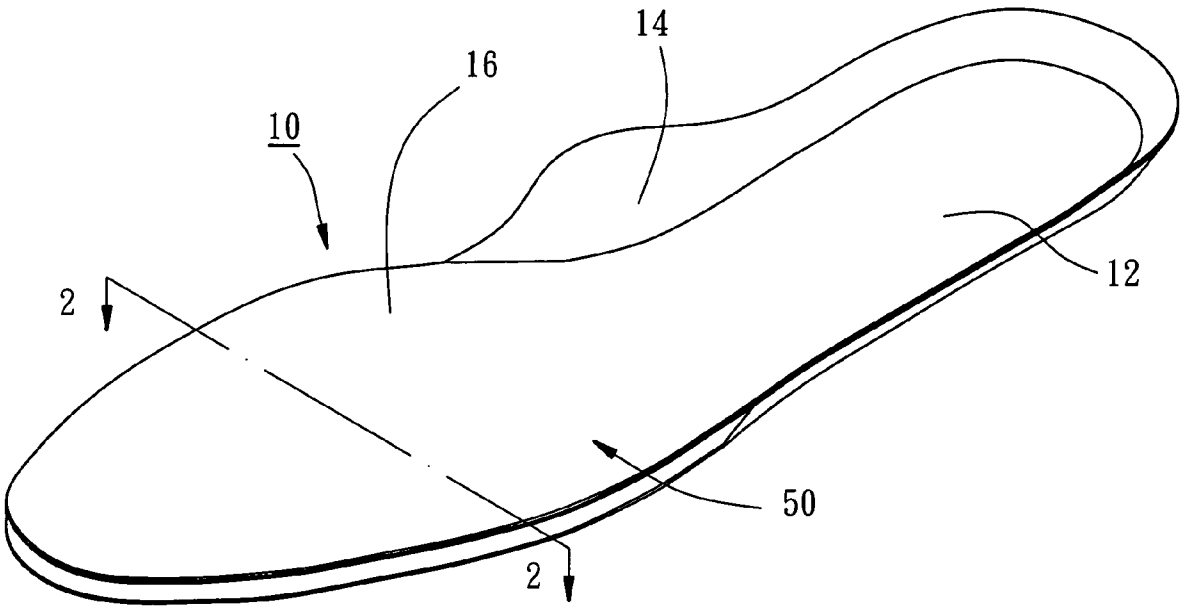
FIG. 1 is a perspective view of an insole according to an embodiment of the present invention.
Figure 2:
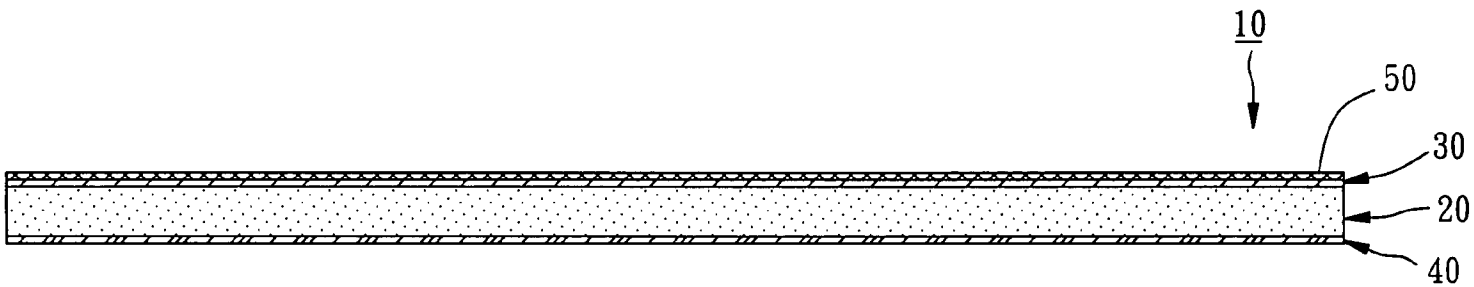
FIG. 2 is a sectional view of the insole of FIG. 1 taken along section 2-2.

Please refer to the drawings, an insole 10 according to an embodiment of the present invention has a heel area 12, an arch area 14, and a forefoot area 16, is laminated by three elastic layers 20, 30, 40 and a fabric layer 50.

The basic layer 20 is made from a second slice foam material produced by bonding together particles of comminuted previously formed foam material with a foamable polyurethane resin composition. Such a foam material has a superior air permeability. In this embodiment, the thickness of the basic layer 20 is about 4 mm.

The upper layer 30 and the bottom layer 40 are adhered respectively to the basic layer 20 in a sandwich manner. These two layers are made from a first slice foam material made of a foamable polyurethane resin. Such a foam material did not mix with any other material and has a tensile strength being better than that of the first foam material. Before slicing to form the upper layer 30 and the bottom layer 40, the first slice foam material is modified by a crushing process to eliminate the beads existing therein. Such a crushing process can improve the air permeability of the second foam material. In this embodiment, the thickness of the upper and bottom layer 30,40 is about 0.5 mm.

The fabric layer 50 is adhered to the upper surface of the upper layer 30. In producing, the raw material to form the fabric layer 50 is first adhered to the first slice foam material and then sliced together to form the upper layer 30 and the fabric layer 50. The function of the fabric layer 50 is to increase the comfort and prevent sliding during wear.

Accordingly, in accordance with the present invention, the primary difference between the insole 10 and the insole disclosed in U.S. Pat. No. 4,642,912 is that the materials for forming the layers of the former are different. As a result, the tensile strength, the resilience and the air permeability of the insole according to the present invention are all better than the prior art insole. For example, the resilience of the insole 10 is 90% and that of the prior art insole is under 70%. The air permeability of the insole 10 is 500 $l/m^2$ sec and that of the prior art insole is only 200~300 $l/m^2$ sec.

What is claimed is:

1. A multiply insole having a heel area, an arch area, and a forefoot area, each defined on the top surface and corresponding to the respective areas of the foot, said insole comprising:

a first layer made of a first slice foam material which is formed by a foamable polyurethane resin composition and modified by a crushing process;

a second layer made of a second slice foam material formed by bonding together particles of comminuted previously formed foam material with a foamable polyurethane resin composition, said second layer being adhered to an upper surface of said first layer;

said second layer having a thickness being greater than that of said first layers;

said first layer having a tensile strength being greater than that of said second layer; and said second layer having an air permeability being greater than that of said first layer.

2. The insole according to claim 1 further comprising a fabric layer being adhered to an upper surface of said second layer.

3. The insole according to claim 2 which has a resilience of 90%.

4. The insole according to claim 3 which has an air permeability of 500 $l/m^2$ sec.

5. The insole according to claim 2 which has an air permeability of 500 $l/m^2$ sec.

6. The insole according to claim 4, wherein the arc area extends upwardly and outwardly from the forefoot area.

7. The insole according to claim 1 further comprising a third layer made of said first slice foam material, said third layer being adhered to a upper surface of said second layer.

8. The insole according to claim 7 wherein said third layer having a thickness smaller than that of said second layer.

9. The insole according to claim 7 further comprising a fabric layer being adhered to an upper surface of said third layer.

10. The insole according to claim 9 which has a resilience of 90%.

11. The insole according to claim 10 which has an air permeability of 500 $l/m^2$ sec.

12. The insole according to claim 11, wherein the arc area extends upwardly and outwardly from the forefoot area.

13. The insole according to claim 9 which has an air permeability of 500 $l/m^2$ sec.

14. The insole according to claim 1, wherein the arc area extends upwardly and outwardly from the forefoot area.

15. The insole according to claim 14, wherein the arc area extends along the periphery of the heel area.

* * * * *